US007347664B2

(12) United States Patent
Kayser et al.

(10) Patent No.: US 7,347,664 B2
(45) Date of Patent: Mar. 25, 2008

(54) HIGH-TEMPERATURE COMPONENT FOR A TURBOMACHINE, AND A TURBOMACHINE

(75) Inventors: Andreas Kayser, Wuppertal (DE); Ivo Wolter, Geldern (DE)

(73) Assignee: Siemens Aktiengesellschaft, Munich (DE)

( * ) Notice: Subject to any disclaimer, the term of this patent is extended or adjusted under 35 U.S.C. 154(b) by 561 days.

(21) Appl. No.: 11/062,303

(22) Filed: Feb. 18, 2005

(65) Prior Publication Data

US 2005/0186082 A1 Aug. 25, 2005

(30) Foreign Application Priority Data

Feb. 23, 2004 (EP) ..... 04004021

(51) Int. Cl.

| | |
|---|---|
| ***F01D 5/16*** | (2006.01) |
| ***F01D 5/26*** | (2006.01) |
| ***F01D 5/28*** | (2006.01) |
| ***F01D 25/06*** | (2006.01) |

(52) U.S. Cl. ..... 415/200; 416/229 A; 416/500

(58) Field of Classification Search ..... 415/200; 416/229 A, 229 E, 230, 232, 233, 500
See application file for complete search history.

(56) References Cited

U.S. PATENT DOCUMENTS

| | | | | |
|---|---|---|---|---|
| 2,783,966 | A * | 3/1957 | Sorensen | 416/241 R |
| 5,634,189 | A | 5/1997 | Rossmann et al. | |
| 5,820,348 | A | 10/1998 | Fricke | |
| 2003/0185685 | A1 | 10/2003 | Simon | |

* cited by examiner

*Primary Examiner*—Edward K. Look
*Assistant Examiner*—Nathan Wiehe

(57) ABSTRACT

The invention provides a high-temperature component for a turbomachine, in particular for a blade or vane having a main blade or vane part and a blade or vane root, the high-temperature component at least partially comprising, as base material, a porous material which is filled with a viscous filler and is surrounded by a solid layer.

19 Claims, 2 Drawing Sheets

HIGH-TEMPERATURE COMPONENT FOR A TURBOMACHINE, AND A TURBOMACHINE

CROSS REFERENCE TO RELATED APPLICATION

This application claims priority of the European application No. 04004021.4 EP filed Feb. 23, 2004, which is incorporated by reference herein in its entirety.

FIELD OF THE INVENTION

The invention relates to a high-temperature component, in particular a blade or vane having a main blade or vane part and a blade or vane root, for a turbomachine, e.g. for a gas turbine or a compressor. Furthermore, the invention relates to a turbomachine having a high-temperature component of this type.

BACKGROUND OF THE INVENTION

Conventional turbomachines, e.g. turbochargers, compressors, gas turbines, comprise high-temperature components, e.g. blades and vanes, such as guide vanes and rotor blades, carrier elements, ring elements, which are exposed to a high temperature and a corrosive or oxidative atmosphere produced by combustion gases. In addition to thermal loads of this type, the blades and vanes are in particular also exposed to high mechanical loads, e.g. vibrations.

It is usual for the blade or vane to be formed from a main blade or vane part, if appropriate a blade or vane platform and a blade or vane root. The blade or vane root is arranged in a recess at a rotor or stator of a turbomachine. When the turbomachine is operating, various operating states can cause flexural and torsional vibrations, in particular at the transition region from the blade or vane root to the main blade or vane part, which can lead to material fatigue and therefore to a shortened service life. To ensure a sufficiently long service life for the blade or vane, it is known to provide the blade or vane with damping elements to absorb these vibrations. By way of example, it is known to provide the blades or vanes with wires, friction elements or covering strips.

SUMMARY OF THE INVENTION

Therefore, the invention is based on the object of providing a high-temperature component which is protected against torsional and flexural loads in a particularly simple way. Furthermore, a turbomachine of particularly simple design is also to be provided.

According to the invention, the former object is achieved by a high-temperature component for a turbomachine, in particular a blade or vane having a main blade or vane part and a blade or vane root, at least partially comprising, as base material, a porous material which is filled with a viscous filler and is surrounded by a solid layer.

Advantageous refinements form the subject matter of the subclaims.

In this context, the invention is based on the consideration that a high-temperature component which is exposed to high thermal, torsional and flexural loads should be able to make do without complex damping elements for reducing the levels of vibrations. Therefore, the high-temperature component itself should be of suitable design to achieve this purpose. To this end, it is provided that the high-temperature component be formed at least in part, and in particular in the regions which are subject to high levels of vibrational loading, as base material, from a porous material which is filled with a viscous filler and is surrounded by a solid layer. The porous material has the advantage of being particularly thermally stable and resistant to high temperatures. Furthermore, it is distinguished by a high resistance to corrosion, oxidation and other chemicals, such as combustion gases. Suitable selection of the viscous filler moreover makes the high-temperature component particularly mechanically strong and sufficiently resistant to stresses and damping. In the event of mechanical loading of the high-temperature component, e.g. resulting from vibrational movements, a relative movement takes place between the porous material and the fluid filler. The friction which is produced causes damping and therefore a reduction in vibrations and also a reduction in stresses.

It is expedient for the porous material used to be a raw material based on silicon dioxide, a raw material based on aluminum oxide, a raw material based on zirconium oxide, a raw material based on magnesium oxide or a raw material based on mica and aluminosilicates. The material may also be based on silicon carbide or aluminum titanate or another material with a carbide or nitride structure or metal materials. These raw materials are distinguished by a high thermal stability and resistance to high temperatures and to fluctuating thermal loads. Moreover, these raw materials are particularly resistant to corrosion and oxidization.

It is preferable for the porous material to have a porosity of at most 20%, in particular of from 5% to 15% or of from 10% to 15%. The porosity is to a crucial extent dependent on the use of the high-temperature component, in particular on the loading imposed on it by centrifugal forces and resulting flexural and torsional stresses. For example, for a turbine blade or vane a porosity of at most 20% is advantageous, since at this level the vibrations which occur are absorbed to a sufficient extent at the turbine blade or vane. The porous material may also have a porosity which varies. In particular, the high-temperature component may be formed from a porous material with a low porosity and a high porosity in regions, as a function of the prevailing thermal loads and vibrational loads. A porous material with a low porosity of at most 20% is provided in regions with a high level of load, e.g. in the transition region between a blade or vane root and a main blade or vane part. In a region of the high-temperature component which is subject to lower levels of load, this component may be formed from a porous material with a high porosity of greater than 20%, in particular from 40% to 60%. As an alternative or in addition, the porous material has a variable pore size. By way of example, the porous material has a mean pore size of from 20 μm to 70 μm, in particular from 40 μm to 50 μm.

The base material is particularly advantageously formed as a granular material, the grains of which, by virtue of their surface shape, bear against one another so as to form a multiplicity of relatively small cavities.

It is expedient for the viscous filler used to be a fluid, in particular a heat-resistant fluid. By way of example, the viscous filler used is a lubricant, in particular a polyalkylene glycol, a synthetic hydrocarbon, a dicarboxylic acid and polyol ester, a silicone, a polyphenyl ether, a fluorohydrocarbon. Furthermore, it is possible to use a phosphate. The synthetic hydrocarbon used may, for example, be poly-alpha-olefins, diakyl benzenes, polyisobutylenes. Viscous fillers of this type are distinguished by a high thermal stability, resistance to oxidation, high-pressure stability and viscosity-temperature properties. Alternatively, the viscous filler used may also be a wax material or a liquid metal filling.

The porous material and the viscous filler are mixed in a ratio of 4 to 1, of 3 to 1 or of 2 to 1, depending on the type and function of the high-temperature component and the mechanical load on it, as well as the thermal load to which it is subject. Other mixing ratios are also possible and depend primarily on the use of the high-temperature component and the operating conditions which occur.

To produce a surface of the high-temperature component which is sufficiently hard with respect to the loads to which it is subject, there is provision for the surface layer to be a solid layer made from a metal material, in particular from a heat-resistant alloy, which is substantially formed from at least one Ni-based material, Cr-based material, Co-based material, Fe-based material and/or Ti-based material. By way of example, the material may be a steel alloy based on NiCr, based on CoCr, based on NiCrAl, NiCoCr or CoCrAl.

It is expedient for the solid layer of the high-temperature component to have a thickness of from 100 μm to 1000 μm, in particular from 180 μm to 300 μm or from 200 μm to 500 μm, in order to provide sufficient protection against corrosion and wear.

It is preferable for the high-temperature component to be formed entirely from the porous material which is filled with the viscous filler material and surrounded by the solid layer. In the case of a high-temperature component designed as a blade or vane, the main blade or vane part and the blade or vane root are formed entirely from the porous material. Alternatively, the blade or vane may, as seen in the longitudinal direction of the main blade or vane body, be formed in regions from the porous material which is filled with the viscous filler and surrounded by the solid layer. By way of example, the main blade or vane part may be formed from the porous material at least in regions, in particular over a length of 10%, 20%, 30% to 45% of the total length of the main blade or vane part. In other words: at least one third up to half of the main blade or vane part is formed from the porous material which is filled with the viscous filler and surrounded by the solid layer.

One possible use of a high-temperature component formed in this way is as a stationary vane in a turbomachine. Alternatively, the high-temperature component may be designed as a moveable blade in a turbomachine. Other uses as a carrier element, bearing element or ring element in a turbomachine are also possible.

The advantages achieved by the invention consist in particular in the fact that sufficient protection against mechanical loads caused by vibrations, e.g. flexural and torsional vibrations, is provided with a high-temperature component which at least in part as base material has a porous material which is filled with viscous filler. Furthermore, it is additionally possible to provide damping elements. The damping effected by the use of the porous material on account of the relative movement between the porous material and the viscous filler leads to a reduction in vibrations and therefore to a reduction in the load on the high-temperature component caused by mechanical stresses, so that the service life of the high-temperature component is extended.

BRIEF DESCRIPTION OF THE DRAWINGS

Exemplary embodiments of the invention are explained in more detail with reference to a drawing, in which.

DETAILED DESCRIPTION OF THE INVENTION

Parts which correspond to one another are provided with identical reference symbols throughout the figures.

Figure 1:
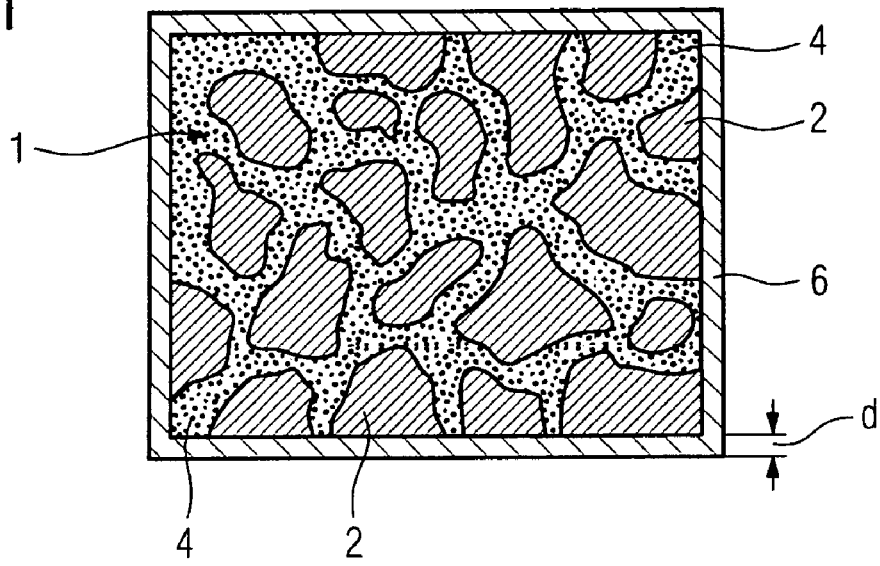
FIG. 1 diagrammatically depicts a base material for a high-temperature component, FIG. 2 diagrammatically depicts a high-temperature component which is designed as a blade or vane and is formed at least in part from the base material.

FIG. 1 shows a base material 1 which is formed from a porous material 2. The porous material 2 is filled with a viscous filler 4 and surrounded by a solid layer 6.

The porous material 2 used is, for example, a raw material based on silicon dioxide, a raw material based on aluminum oxide, a raw material based on zirconium oxide, a raw material based on magnesium oxide, a raw material based on aluminum titanate, a raw material based on silicon carbide or a raw material based on mica and aluminosilicates. Depending on the specific stipulations, the porous material may have a porosity of at most 20%, in particular from 5% to 15% or from 10% to 15%. The porous material 2 may also have a porosity which varies, e.g. from 10%, 20% to at most 30%, or a variable pore size, e.g. a mean pore size of from 20 μm to 80 μm, in particular from 20 μm to 40 μm or 40 μm to 60 μm.

The viscous filler 4 used is a fluid, in particular a heat-resistant fluid. Depending on the operating conditions, e.g. under thermal loading of greater than 800° C. up to 1200° C., the viscous filler 4 used may be a lubricant, in particular polyalkylene glycols, synthetic hydrocarbons, dicarboxylic acid and polyol esters, silicones, polyphenyl ethers, fluorohydrocarbons. These viscous fillers 4 are distinguished by the fact that they do not flocculate under thermal loads of this type and therefore effect a relative movement between the porous material 2 and the viscous filler 4 even in the event of the base material 1 being subject to vibrational loads, for example as a result of centrifugal forces. This relative movement then leads to a reduction in vibrations.

Depending on the load on the base material 1, the porous material 2 and the viscous filler 4 are mixed in a ratio of 4 to 1, 3 to 1 or 2 to 1 or in any other desired mixing ratio. To protect the base material 1 from external corrosion and heat, the solid layer 6 provided is a metal material composed of a heat-resistant alloy, which is substantially formed from at least one Ni-based material, Co-based material, Fe-based material and/or Ti-based material. The solid layer 6 has a thickness d of, for example, 100 μm to 1000 μm, in particular of 180 μm to 350 μm, or of 350 μm to 500 μm.

Figure 2:
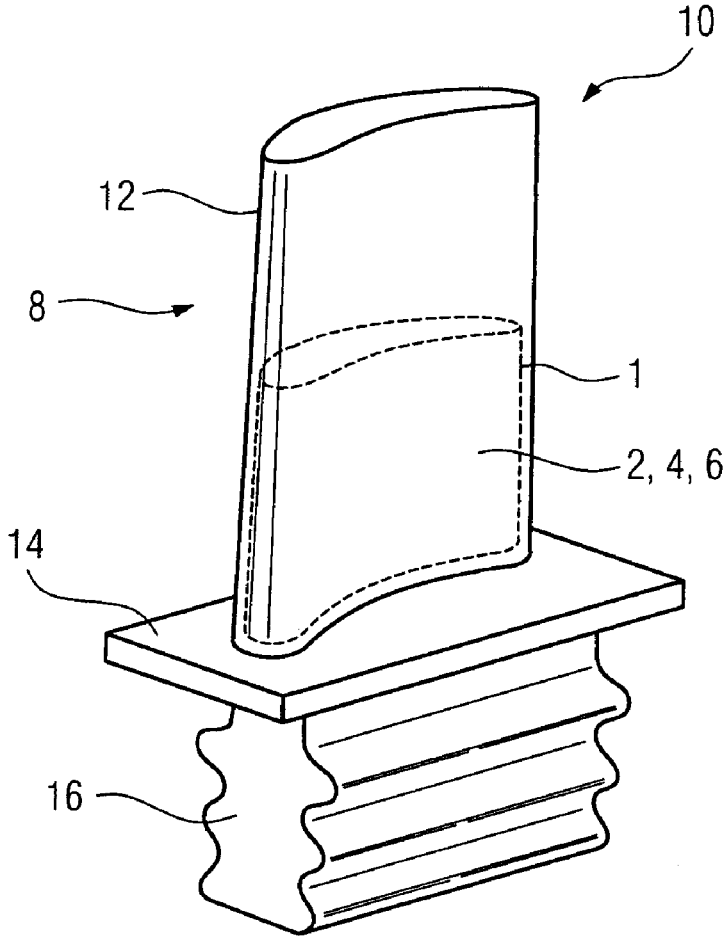

FIG. 2 shows a high-temperature component 8 which is designed, for example, as a blade or vane 10, e.g. as a guide vane or rotor blade, as a stationary or moveable vane or blade, for a turbomachine (not shown in more detail). Alternatively, the high-temperature component 8 may also be designed as a carrier element, bearing element or ring element for a turbomachine.

In the exemplary embodiment, the blade or vane 10 is formed from a main blade or vane part 12, a blade or vane platform 14 and a blade or vane root 16. Alternatively, the blade or vane 10 may, in a manner not illustrated in more detail, also comprise an upper and a lower blade or vane platform, depending on the type of blade or vane. The blade or vane 10 is arranged in the turbomachine by means of the blade or vane root 14.

Depending on the type of blade or vane and the use of the blade or vane in the turbomachine, i.e. the type of load on the blade or vane 10, the blade or vane may be formed completely from the porous material 2 which is filled with the viscous filler 4 and surrounded by the solid layer 6, i.e. the blade or vane root 16, the blade or vane platform 14 and the main blade or vane part 12 are formed from the base material 1. Alternatively, as illustrated in FIG. 2, it is possible for only the main blade or vane part 12 to be formed, at least in regions, from the porous material 2 which is filled with the viscous filler 4 and surrounded by the solid layer 6. The blade or vane root 16, the blade or vane platform 14 and the end of the main blade or vane part are formed from conventional blade or vane material, e.g. from an alloy based on nickel, chromium, cobalt, iron and/or titanium.

By way of example, at least one third up to half of the main blade or vane part 12 may be formed from the base material 1 and therefore from the porous material 2 which is filled with the viscous filler 4 and surrounded by the solid layer 6.

Figure 3:
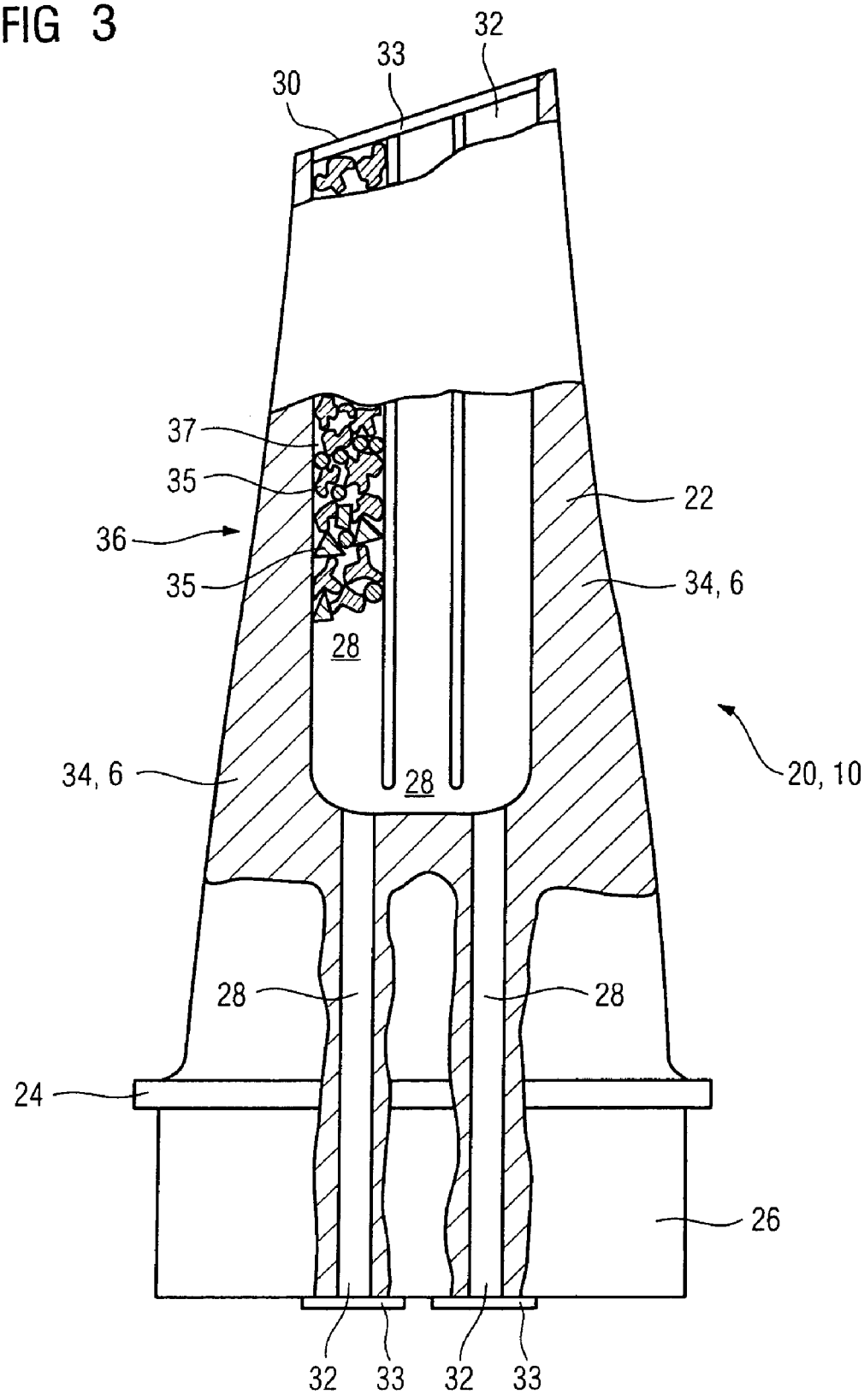
FIG. 3 shows a cast rotor blade having a main blade or vane part, a platform and a blade or vane root, in the form of a partial section.

FIG. 3 shows a cast rotor blade 20 having a main blade part 22, a platform 24 and a blade root 26, in the form of a partial section.

The main blade part 22 and the blade root 26 are at least partially hollow in form. For this purpose, a casting apparatus (not shown) which is used to cast the rotor blade 20 has casting cores which are removed after the rotor blade 20 has been cast, thereby leaving behind the cavities 28. In the casting apparatus, the casting cores extend from the blade root 26 through the rotor blade 20 to the main blade tip 30, so that the casting cores are secured to the casting apparatus outside the rotor blade 20. The rotor blade 20 which is cast using this casting apparatus has core-holding openings 32 produced by the casting cores at the main blade tip 30 and at the blade root 26.

After the rotor blade 20 has been cast, the core-holding openings 32 arranged at the main blade tip 30 are closed up tightly by fitting stoppers, by soldering or welding on metal sheets 33 or by other suitable and known means and processes.

Then, the abovementioned porous materials and viscous fillers can be introduced into the cavities 28 in the rotor blade 20 through the core-holding openings 32 arranged at the blade root 26. Alternatively, it is possible to introduce only a quartz sand or granules of visco-elastic substances into the hollow rotor blade 20 as vibration-absorbing material. The cast walls 34 of the rotor blade 20 then surround the filler material which dissipates the vibrational energy, as the solid layer 6. Furthermore, as an alternative to the porous materials it is also possible for a granular material 36 to be used as the base material. FIG. 3 only indicates the granular material in one cavity 28. On account of the grains 35 having a suitable, in particular irregular, shape, they bear against one another, so as to form a multiplicity of relatively small cavities 37, into which the viscous filler can be introduced if required.

After the rotor blade 20 has been filled, the core-holding openings 32 arranged at the blade root 26 are closed off tightly in the same way as the core-holding openings 32 of the main blade tip 30, so that the filler material is permanently and securely enclosed within the rotor blade 20.

Furthermore, securing the casting cores outside the rotor blade 20 has the advantage that the fixing pins which are otherwise customary and hold the casting cores with respect to one another can be dispensed with. Furthermore, the improved fixing of the casting cores also results in more uniform wall thicknesses of the main blade part 22, which brings about better temperature distribution and stress distribution within the walls 34 of the main blade part 22 and therefore leads to a further increase in the service life of the rotor blade 20.

The invention claimed is:

1. A turbine blade or vane component for use in a high temperature application, comprising:

a blade or vane airfoil portion;

a blade or vane root portion;

a blade or vane platform portion; and a base material, wherein a portion of the base material is a porous material that is filled with a viscous filler and is surrounded by a solid layer.

2. The turbine blade or vane component as claimed in claim 1, wherein the porous material is a raw material based on a material selected from the group consisting of: silicon dioxide, aluminum oxide, zirconium oxide, magnesium oxide, and mica and aluminosilicates.

3. The turbine blade or vane component as claimed in claim 1, wherein the porous material has a porosity of at most 20%.

4. The turbine blade or vane component as claimed in claim 1, wherein the porous material has a porosity in the range of 10% to 15%.

5. The turbine blade or vane component as claimed in claim 1, wherein the porous material has a varying porosity.

6. The turbine blade or vane component as claimed in claim 1, wherein the porous material has a variable pore size.

7. The turbine blade or vane component as claimed in claim 1, wherein the base material is a granular material that forms a multiplicity of relatively small cavities.

8. The turbine blade or vane component as claimed in claim 1, wherein the viscous filler is a heat-resistant fluid.

9. The turbine blade or vane component as claimed in claim 1, wherein the viscous filler is a lubricant selected from the group consisting of: polyalkylene glycols, synthetic hydrocarbons, dicarboxylic acid and polyol esters, silicones, polyphenyl ethers, and fluorohydrocarbons.

10. The turbine blade or vane component as claimed in claim 1, wherein the viscous filler is a wax material.

11. The turbine blade or vane component as claimed in claim 1, wherein the porous material and the viscous filler are mixed in a ratio of 4 to 1, of 3 to 1 or of 2 to 1.

12. The turbine blade or vane component as claimed in claim 1, wherein the solid layer is a metal material made from a heat-resistant alloy and is substantially formed from a material selected from the group consisting of: a Ni-based material, a Co-based material, a Fe-based material, a Ti-based material, and combinations thereof.

13. The turbine blade or vane component as claimed in claim 1, wherein the solid layer has a thickness in the range of 100 μm to 1000 μm.

14. The turbine blade or vane component as claimed in claim 1, wherein the main blade or vane part and the blade or vane root are formed entirely from the porous material which is filled with the viscous filler and surrounded by the solid layer.

15. The turbine blade or vane component as claimed in claim 1, wherein the main blade or vane part has regions formed from the porous material and is filled with the viscous filler and surrounded by the solid layer.

16. The turbine blade or vane component as claimed in claim 15, wherein one third to half of the main blade or vane part is formed from the porous material and is filled with the viscous filler and surrounded by the solid layer.

17. A turbine component for use in a high temperature application, comprising:

a base material, wherein a portion of the base material is a porous material that is filled with a viscous filler and is surrounded by a solid layer.

18. The turbine component as claimed in claim 17, wherein the component is a carrier element, bearing element or a ring element in a turbomachine.

19. A turbomachine, comprising:

a turbine blade or vane for use in a high-temperature application; comprising:

a blade or vane airfoil portion;

a blade or vane root portion;

a blade or vane platform portion;

a base material, wherein a portion of the base material is a porous material that is filled with a viscous filler and is surrounded by a solid layer.

* * * * *